US005228589A

United States Patent [19]

Della Riva

[11] Patent Number: 5,228,589

[45] Date of Patent: Jul. 20, 1993

[54] STACKABLE PACKAGING WITH FIXED SPOUT FOR LIQUID OR PULVERULENT PRODUCTS

[75] Inventor: Carlo Della Riva, Brussels, Belgium

[73] Assignee: S.A. Incoplas N.V., Brussels, Belgium

[21] Appl. No.: 917,360

[22] Filed: Jul. 23, 1992

[30] Foreign Application Priority Data

Jul. 25, 1991 [BE] Belgium ..... 9100700

[51] Int. Cl.[5] ..... B65D 35/00

[52] U.S. Cl. ..... 220/462

[58] Field of Search ..... 220/462, 463; 206/446, 206/486

[56] References Cited

U.S. PATENT DOCUMENTS

| | | | |
|---|---|---|---|
| Re. 33,128 | 12/1989 | Nordstrom | 222/105 X |
| 3,039,648 | 6/1962 | Busch | 220/462 |
| 4,445,613 | 5/1984 | Cassidy | 206/486 X |
| 4,524,883 | 6/1985 | Herring | 220/462 |
| 4,850,506 | 7/1989 | Heaps, Jr. et al. | 222/105 X |
| 5,050,775 | 9/1991 | Marquardt | 220/462 X |
| 5,076,471 | 12/1991 | Coleman | 222/105 |

*Primary Examiner*—Steven M. Pollard
*Attorney, Agent, or Firm*—Leonard Bloom

[57] ABSTRACT

The packagings (1, 101) of the invention consist in an assembly composed of a cardboard box (2, 102) and of a bottle (3, 103) made from plastic material contained in this box (2, 102), the neck (14, 112) of the bottle (13, 103) being engaged in an opening (8, 104) provided in the transverse wall (6, 105) of the box (2, 102). The packagings (1, 101) comprise, moreover, an element for protecting the neck, carried by the box (2, 102) and arranged so that it surrounds the spout (15, 113) and so that its upper edge extends beyond that of the positioned stopper (16).

20 Claims, 3 Drawing Sheets

STACKABLE PACKAGING WITH FIXED SPOUT FOR LIQUID OR PULVERULENT PRODUCTS

The present invention relates to a packaging for liquid or pulverulent products which is particularly suitable for food products and chemicals.

BACKGROUND OF THE INVENTION

1) Field of the invention

The packing and transportation of products which can flow (particularly liquid products) have long posed an awkward problem.

Although pulverulent products can be transported in other ways, the invention provides an advantageous alternative.

Metal containers and glass containers are markedly less commonly used than in the past : they are generally heavy, permitting little variation in form, and are relatively expensive. Glass containers are, moreover, breakable, which is a major disadvantage. As for metal containers, these are easily deformed irreversibly if they are dropped.

Consequently, for a few decades now, the use of various containers made from plastic material has become commonplace for packing, inter alia, liquid food products, or for use in industry or in every day life.

All kinds of containers which were formerly made from glass or metal have therefore gradually been replaced by containers made from plastic material which are intended for the same types of use. These new containers permit easier handling and treatment, particularly by virtue of the reduction in risks of breakage or harmful deformations.

A number of problems specific to the use of plastic materials for packaging liquid products have appeared over time, some of which still exist today, which the present invention attempts to remedy.

For reasons of economy, it is desirable for containers made from plastic material to be as light as possible.

With this in mind, and on the basis of forms copied from glass or metal packaging, packaging in plastic material has gradually evolved towards forms which are better adapted to the characteristics of the material, these forms making it possible to optimize resistance to vertical compression, the limit being given by a non-visible and non-permanent deformation of the packaging.

Most of the forms developed which have both good resistance to vertical compression and a light weight nevertheless have a major drawback : the ratio between the volume occupied by the spatial requirement of the packaging and the volume of the liquid product packed is high and in all cases never reaches the optimum value of 1:1. In tear drop-shaped bottles, for example, this ratio is generally greater than 2:1. The loss of volume is thus huge and considerably increases packaging, handling, storage and distribution costs.

Due to their rigidity, most containers made from plastic material also take up considerable space in the volume of domestic or industrial waste. It can easily be understood that it is desirable for this volume to be minimized.

2) Description of the prior art

Extremely light packaging made from plastic material which, after use, occupies a particularly small volume has been on the market for a long time. This packaging is, namely, envelopes or the like made from flexible plastic material, also referred to as sachets, which are provided for packing shampoos, conditioners or food products such as milk. This type of packaging is, however, rarely used, since it is extremely impracticable. Once opened, the envelopes cannot in fact be closed again or kept upright. It is thus necessary to use their contents in one go. Moreover, as there is a thin film without external protection, the risks of leakage are considerable.

Plasticized cardboard boxes of the brick type for milk make it possible to save space during transportation and storage. They comprise a small quantity of plastic material and, after use, occupy a small volume in refuse provided that care is taken to flatten them.

These boxes are manufactured from a cardboard sheet. At least one layer of polyethylene and, optionally, a layer of another material such as aluminium are made integral with the cardboard sheet by being stuck together or by other means. This results in a particularly troublesome drawback from the ecological stand-point : the materials which form the single composite layer of the packaging cannot be dissociated from one another and thus cannot be separated by simple means. Thus, they can neither be destroyed selectively by incineration nor be recovered for the purposes of recycling. Also, since the actual cardboard has been plasticized, it is rendered rot proof.

The method of opening boxes of the brick type for milk is as follows : the user must lift a part, which is folded on the top of the box and folded over the sides, and cut off its corner. If the cutting operation is not performed correctly, which often occurs, milk is spilt when the user picks up the brick in order to pour out its contents. No provision is made, after opening, for the possibility of reclosing this type of packaging.

For packing liquid washing agents, packaging formed from a combination of cardboard and sheets of plastic materials which can, in certain cases, be reclosed each time the product is used, has recently been developed.

Particularly, packaging of the brick type for milk described above, whose method of opening is different, has been marketed : a pouring spout, consisting of an injection-moulded component made from polyethylene, is glued to the center of the upper wall of the box. When using the container for the first time, the consumer must himself pierce a hole in the wall of the packaging, through the spout, thus creating lips which face the inside of the box and which prevent total emptying of the box. As the spout is applied to the outer part of the composite film forming the wall of the packaging, it can become detached in the event of impact or rough treatment. As with bricks for milk, any recycling of plastic material or of cardboard is impossible.

Moreover, stacking and palletization are difficult due to the projecting pouring spout.

Another type of packaging known on the market and provided for liquid washing agents permits easier pouring of the product. This is packaging which consists of a cardboard sheet which has been given the form of a box, in which a sheet of plastic material welded into the form of a bag is glued at several points. The upper wall of this packaging is manufactured with an off-center hole. A spout which is integral with the cardboard and with the sheet of plastic material is positioned at the location of the hole provided on the top of the box. Opening, closing and pouring of the product are relatively easy. Nevertheless, it is observed that, in practice, due in particular to the parallelepipedal form of the box, it is also virtually impossible to empty.

Once again, the components (cardboard and plastic material) are very difficult to dissociate from one another, which is undesirable from an ecological standpoint. Moreover, this type of packaging requires the use of a considerable amount of adhesive. Finally, the problems of stacking and palletization are still not solved.

There is a particular model of this type of packaging which has a large opening provided in the cover. The spout, which is then integral only with the sheet of plastic material, is able to retract into the box via this opening. What frequently happens now is that it moves obliquely and disappears inside the box, from where it is then awkward to recover. The direction of the flow of product is not guaranteed either, on pouring.

There is also another particular model of this type of packaging, in which the spout is located in a "cut corner" of the cardboard box. In this case, the resistance of the packaging to vertical compression is diminished.

The packaging mentioned above is not designed in order to be filled via the spout. It must be manufactured and filled by complicated and expensive machines which make the cardboard, apply the plastic material thereto and proceed immediately to filling. In each case, this means that the manufacturer of the packaged product must transport his merchandise in bulk to the premises where the packaging is manufactured or invest in machines for manufacturing and filling the packaging, which involves additional cost.

U.S. Pat. No. 4,143,718 describes a packaging comprising a container surrounded by a cardboard box. The design of the carton is such that it is impossible to carry out filling of the completely assembled container on a conventional filling line. It is necessary either to previously fill the inner container (which, in this case, has itself to be relatively rigid, such as a glass bottle), or to break down the folding of the carton into two partial folding operations, which complicates the apparatus of the chain. Once packing is finished, the spout is in fact accessible only by tearing part of the carton.

Application GB 2,228,725 describes a packaging composed of a container in plastic material surrounded by a carton. The orifice of the container is arranged set back relative to the upper face of the carton so as not to extend beyond the latter. The orifice of such a container, clearly intended to contain corrosive liquids, is connected, for draining, to a pumping device. In this case, there is no pouring problem.

SUMMARY OF THE INVENTION

The invention aims to provide packaging for liquid or pulverulent products, composed of cardboard and an amount of plastic material which is small compared with the content of the packaging, which permits total separation of its constituent materials, which can be sorted before being discarded, and which permits selective collection and recycling of the constituent materials.

An object of the invention is to provide a packaging for liquid or pulverulent products which occupies as small a volume as possible after the product has been used.

A major object of the invention is to provide packaging which, although composed of two elements, has a total weight which is no greater than that of a traditional bottle.

The invention also aims to provide packaging for liquid or pulverulent products which can easily be stacked and palletized and which has a configuration such that the ratio of the volume occupied by the spatial requirement of the packaging to the volume of the packed product is very close to the value 1, and for this to be so while retaining the characteristics of good resistance to vertical compression exhibited by conventional bottles made from plastic materials.

A further object of the invention is to provide packaging for a liquid product, composed of cardboard and of plastic material, which can be manufactured on traditional machines and filled on traditional filling lines used for filling bottles.

The invention further aims to provide packaging for liquid or pulverulent products which makes it possible to easily pour the product contained therein, while preventing any spilling of the latter, which packaging can be opened and reclosed easily after use and which, above all, makes it possible to use all the product, so as to avoid any wastage and any mixing of product residue with other domestic or industrial refuse.

A further object is to reduce the handling operations required of the user.

A final object of the invention is to provide packaging for liquid or pulverulent products in which the risk of leakage is reduced.

The subject of the invention is packaging for liquid or pulverulent products, which consists in an assembly comprising a cardboard box and a bottle made from plastic material contained in this box without being attached thereto, that is to say without being glued or welded thereto, such that the bottle can be separated from the box very easily and without any tearing after this box has been opened. The box in question comprises lateral walls and a transverse wall. An opening is provided in the latter. The bottle comprises a base, a body, a neck capable of being engaged in the opening of the transverse wall and a spout on which a stopper is fitted. The bottle occupies a position in which its neck is engaged in the opening of the transverse wall of the box and its spout is located outside the box. In this position it can be filled via the spout, the stopper can be positioned or removed as often as required and the contents of the bottle can be poured out via the spout.

The packaging according to the invention comprises, moreover, an element for protecting the spout, carried by the box, arranged so that it surrounds the spout and so that its upper edge extends beyond that of the positioned stopper, this element for protecting the spout comprising an enclosure formed by extensions of the lateral walls and folded-over faces adjoining these extensions, one of the extensions comprising cutter lines arranged so as to form, after detachment of the cardboard piece located between the cutter lines, a notch facilitating pouring-out of the contents of the bottle.

The cardboard box according to the invention is preferably formed from a single cardboard blank. The extensions of the lateral walls as well as the transverse wall are formed by virtue of a double folding of the cardboard blank, the first fold forming the upper edge of the extensions of the lateral walls and the second fold forming the junction between the transverse walls and the extensions of the lateral walls.

In a preferred embodiment of the invention, the element for protecting the spout comprises, moreover, a cup capable of being engaged on the inner perimeter of the transverse wall of the box.

The cup advantageously comprises vertical faces which are frictionally engaged against the lateral walls of the protecting enclosure.

According to a preferred embodiment of the invention, one of the extensions (which cannot be that comprising the cutter lines) comprises a window capable of forming a handle. This window is delimited by cutting lines and a folding line forming a hinge. The cardboard piece located between the cutting lines and the hinge can be folded over so as to leave an opening of a size such that four fingers may be inserted therein.

The extension comprising the window is preferably located opposite that which comprises the cutter lines, this being in the case where the box comprises an even number of lateral walls.

According to a preferred embodiment of the packaging of the invention, the neck of the bottle is equipped, at least over a part of its height, with means which can interact with the transverse wall of the box in order to ensure holding of the spout outside this box when the neck is engaged in the transverse wall. These means may consist of a collar which surmounts the lower part of the neck.

The cardboard box may optionally be devoid of a base (on the side opposite the transverse wall in which an opening is provided).

However, this box can normally be provided with such a base on which the base of the bottle may bear.

This base may optionally be incomplete and formed, for example, from lips of the lateral walls folded inwards at the lower part of the box, the width of these edges being such that there is still an opening in the center of this box base.

According to a preferred embodiment, the body of the bottle is sufficiently flexible for it to substantially match the lateral walls of the box.

According to a particular embodiment, the spout of the bottle is threaded and the stopper is threaded in a corresponding manner.

However, this type of closure of the spout is not critical in any way and many other stoppering systems may be used such as, for example, "bayonet" closure systems.

Advantageously, the neck of the bottle is equipped, in its lower part, with means which interact with the transverse wall in order to lock the neck (and thus the entire bottle) in terms of rotation when the said neck is engaged in the opening of the transverse wall. The lower part of the neck and the edges of the opening may be notched. They may also have a form which is not circular, for example an oval, ellipitical or polygonal form. Successful use will be made of hexagonal, octagonal, square or even triangular forms.

According to a preferred embodiment, the opening provided in the transverse wall of the box has dimensions such that the edge of this opening laterally surrounds the neck and thus holds the bottle in position.

The body of the bottle of the packaging according to the present invention is preferably equipped, over at least a part of its height and at least a part of its periphery, with stiffening means, for example grooves and ribs which can be arranged either in the axial direction or in the radial direction, or in a combination of the two.

The bottle can have a substantially circular form or, alternatively, a rectangular form with rounded corners or any other desired form. As for the box, it may be cylindrical or prismatic.

A particularly advantageous material for manufacturing the bottle is polyethylene, but it is also possible to use polyethylene terephthalate (PET), polypropylene or other plastic materials which can be recycled or incinerated without releasing harmful gases. The use of polyethylene is advantageous for more than one reason, since it is particularly suitable for recycling.

According to an advantageous embodiment, when the packaging comprises a cup, the base of this cup is flush with the upper end of the enclosure.

The bottle of the packaging of the invention will not generally be self-supporting.

The packaging of the invention is no heavier than a traditional bottle of equal capacity and makes it possible to use up to three times less plastic material.

When pouring the product, it flows continuously without causing air bubbles to rise in the bottle, which makes it possible to direct the flow very accurately.

Because the external presentation of the packaging of the invention is provided by the cardboard box, for manufacturing the light-weight bottle it is possible to use waste plastic material originating from the manufacturing process for conventional packagings. It is thus possible to manufacture a single-layer bottle entirely from recovered plastic material. Its light weight, its consistency and its functionality will be identical to those of a bottle manufactured from fresh material. Only its appearance will be modified, for example if the recovered plastic material originates from silk-screen printing waste, which involves a modification of the color of the bottle.

Moreover, the coextrusion technique today makes it possible to produce multi-layer bottles, with the aim of recycling the plastic material contaminated by the products and originating from the consumer's dustbin. For this recycling to take place, it is essential for the material which has been contaminated, and no longer offers the guarantees of cleanliness currently required for all packaging, to be separated from the contents by a layer of fresh plastic material intended to prevent contact between the recycled and contaminated material and the contents of the packaging.

The color of the recycled material, tending towards a wide variety of grays, requires traditional bottles also to have an external layer of plastic material, referred to as the presentation layer, when the color required for the bottle is incompatible with gray.

A third layer of material, sandwiched between the first two layers, will permit the incorporation of waste originating from the manufacture of the actual packaging (waste which can represent 50% of the net weight of a bottle with a handle, for example) and the use of genuinely recycled material, that is to say contaminated and originating from refuse ("post-consumer" recycling).

The invention makes it possible to increase the proportion of recycled material by doing away with the presentation layer, which is rendered useless given that it is the cardboard which gives the packaging its attractive appearance.

Attempts are currently being made to develop packaging in degradable plastic materials. One of the problems encountered by such projects is the determination of the lifespan of the material before degradation commences.

In the packaging of the invention, the bottle is protected from the light by the cardboard box until the product has been used. It thus makes it possible to use plastic materials which degrade very rapidly through the action of light, that is to say UV radiation. Degradation of the plastic material commences as soon as the bottle is exposed to the light, that is to say as soon as it is separated from the box either due to human action or due to the natural decomposition of the cardboard.

BRIEF DESCRIPTION OF THE VARIOUS FIGURES

Other features and advantages of the invention will emerge from the description of particular embodiments which is given below, reference being made to the appended drawings, in which.

DETAILED DESCRIPTION OF THE DRAWINGS

Figure 1:
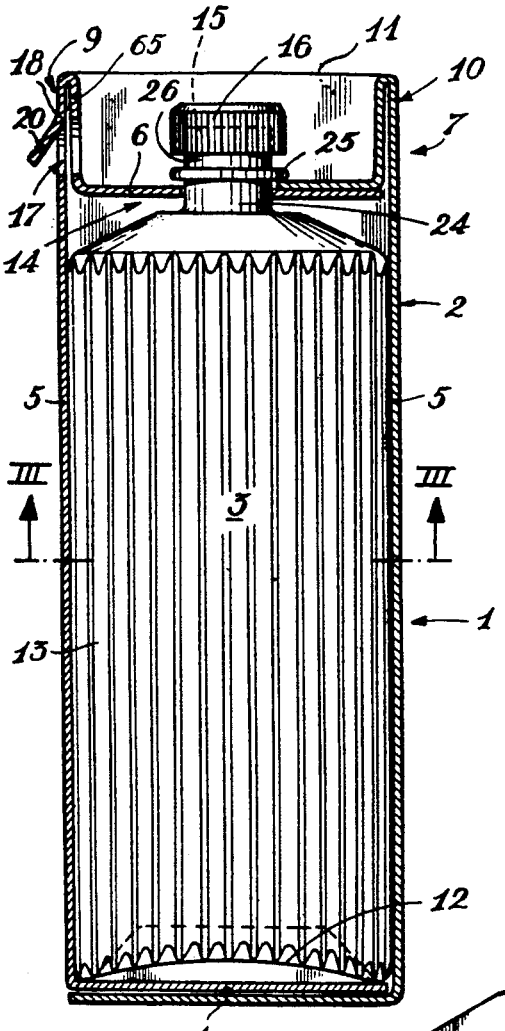
FIG. 1 is a view, partially in section, of packaging for liquid or pulverulent products according to the invention.
Figure 3:
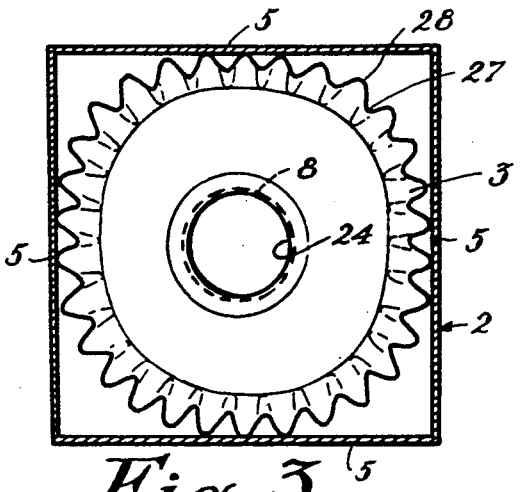
FIG. 3 is a section along the line III—III in FIG. 1.
Figure 2:
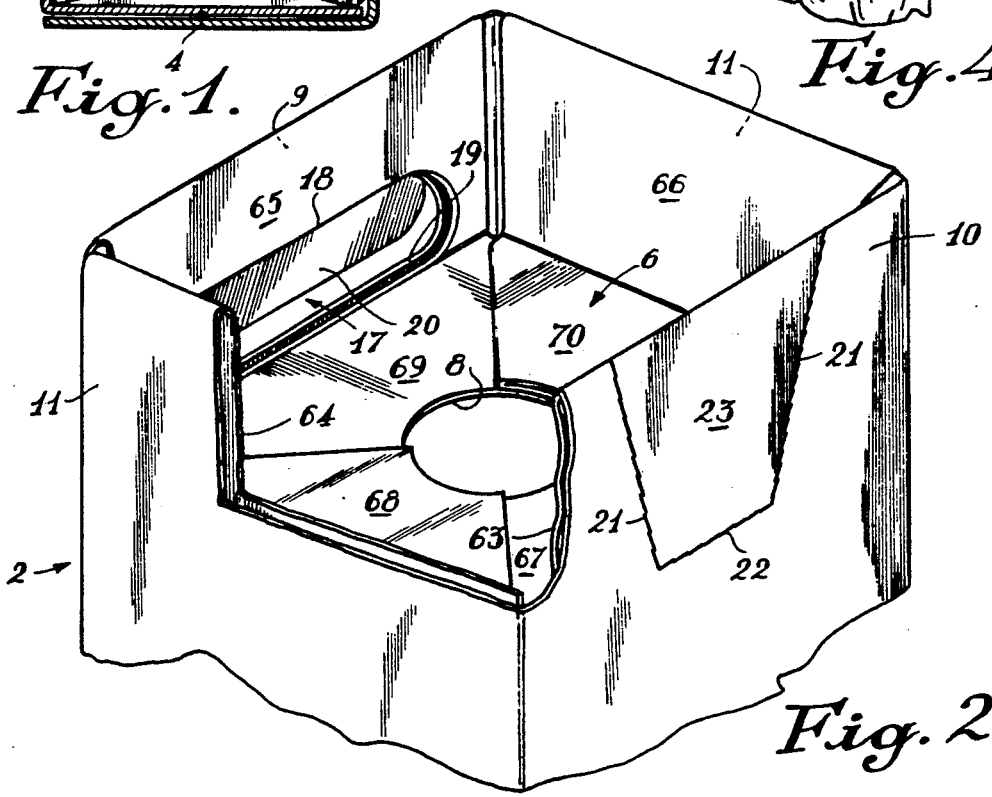
FIG. 2 is a perspective view, with cutaway, of the same packaging, in which the bottle is not shown for reasons of clarity.

FIGS. 1 to 3 show a packaging for liquid or pulverulent products according to the invention, denoted by general reference 1.

This packaging 1 consists of a cardboard box 2 with a square section and a bottle 3. For ease of presentation, the bottle 3 has been shown in elevation and the box 2 in section in FIG. 1. Only the upper part of the box is shown in FIG. 2.

The box 2 comprises a base 4, four lateral walls 5, a transverse wall 6 and an enclosure 7.

A circular opening 8 is provided in the transverse wall 6.

The enclosure 7 consists of extensions 9, 10, 11 of the lateral walls 5 above the level of the transverse wall 6.

Figure 4:
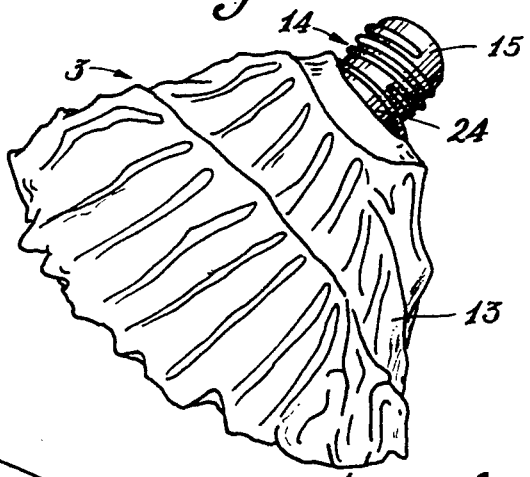
FIG. 4 is a perspective view of a bottle which has been removed, after use, from a packaging according to the invention and has been reduced to a small volume.

The bottle 3 is manufactured from polyethylene; it comprises a base 12, a body 13 of substantially circular section, and a neck 14. The latter extends in terms of height up to the start of the screw thread (shown in FIG. 4) of the threaded spout 15 on which a threaded stopper 16 is screwed.

As may be seen in FIG. 1, the upper edge of the enclosure 7 extends beyond the upper edge of the stopper 16. This gives the enclosure 7, when the package is stored, a role of protecting the spout 15.

The extension 9 of one of the lateral walls 5 comprises a window 17 of elongated form. This window 17 is delimited by a straight folding line forming a hinge 18 and cutting lines 19. The cardboard piece 20, located between the cutting lines 19 and the hinge 18, may be folded over and then forms an opening forming a handle of a size such that four fingers of a hand may be inserted therein.

The extension 10, opposite the extension 9, comprises oblique cutter lines 21 and a horizontal cutter line 22, joining the two cutter lines 21. These cutter lines 21, 22 enable the user to detach a cardboard piece 23 of trapezoidal form. This removal renders pouring out (and, in particular, measuring) of the product contained in the bottle possible and even extremely convenient.

The body 13 of the bottle 3 is approximately 0.2 mm thick. As may be seen in FIG. 4, when the bottle 3 is empty, it can easily be separated from the box 2, to which it is not attached either by gluing or by welding or in any other manner. It may then be rolled by hand like a toothpaste tube, which enables it to occupy a very small volume in waste.

This also makes it possible to extract the very last drop of the product. As for the box 2, it can be flattened like any cardboard box.

The bottle 3 occupies, relative to the box 2, a position in which its contents can be poured out (when the cardboard piece 23 has been detached) and in which it can be stored and transported without the risk of deformation of the spout. It may then be treated as a simple bottle and, particularly, be filled on conventional bottle-filling lines.

The neck 14 is divided into three distinct elements along its height : the lower part 24, the collar 25 and the upper part 26.

The collar 25 bears on the transverse wall 6 and holds the bottle 3 so that the lower part 24 of the neck 14 is permanently engaged in the opening 8 of the transverse wall 6. It can be wedged in rotation therein, for example by virtue of a notching (not shown) of the edges of the opening 8 and of the lower part 24 of the neck 14. It is also possible to give the opening 8 and the neck 14 an oval form.

The opening 8 of the transverse wall 6 has a diameter such that it encloses the lower part 24 of the neck 14.

FIG. 3 shows that the bottle 3 substantially matches the lateral walls 5 of the box 2. Over its entire periphery, its body 13 has a corrugated form, thus forming a succession of grooves 27 and ribs 28 disposed in the axial (vertical) direction. It is also possible to provide smooth zones corresponding to the central part of each lateral wall.

As the walls of the bottle 3 are very thin, particularly when the packaging 1 is filled with liquid product, the lateral walls 5 of the box 2 can, in the long term, swell, principally in the lower third of the packaging 1 where the greatest pressure is exerted. In order to alleviate this drawback, the body 13 of the bottle 3 has, in the corresponding zone, a slightly smaller section than in the other parts, so as to counteract the appearance of such a swelling. This characteristic is obviously not apparent when the bottle 3 is full.

Figure 5:
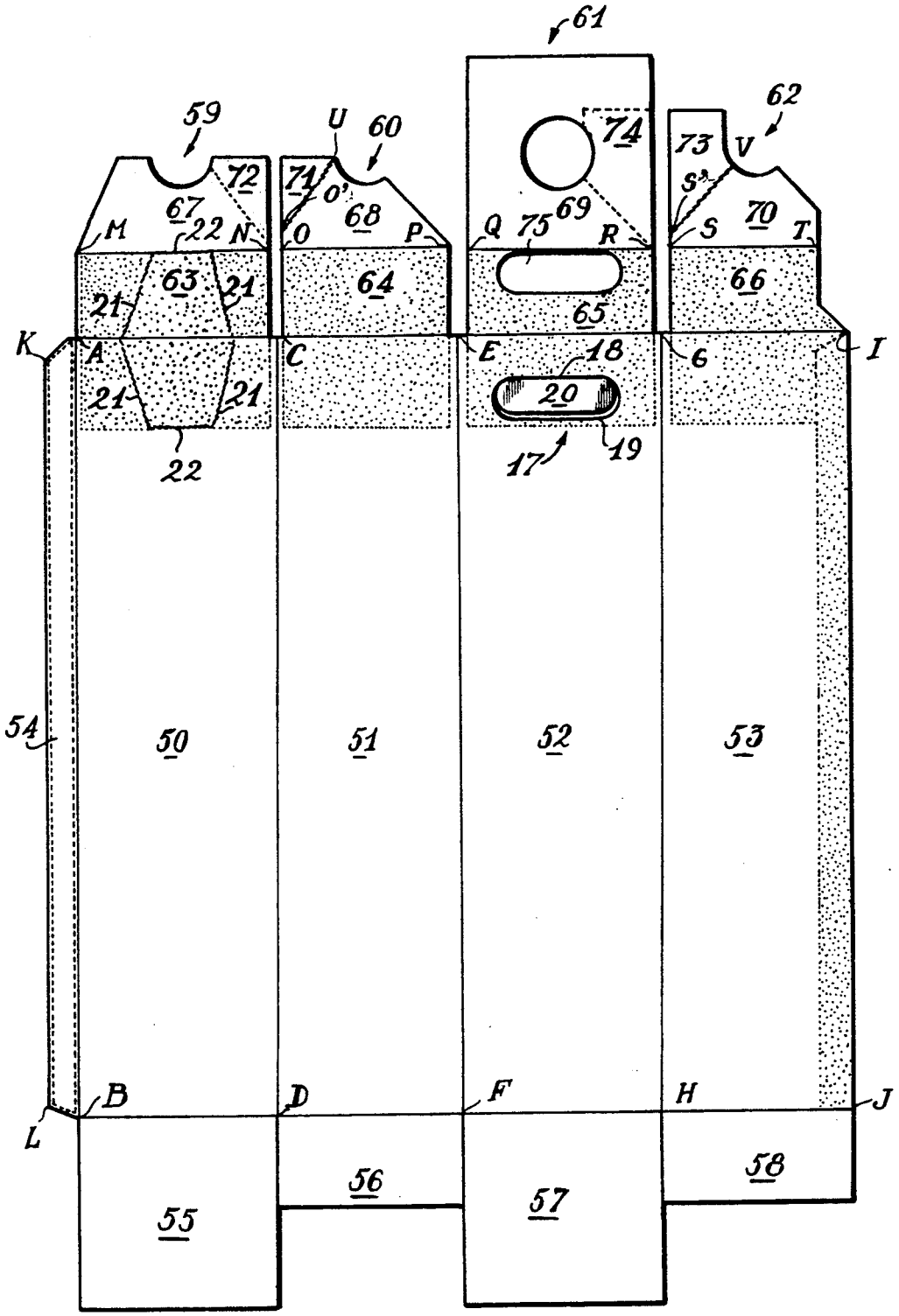
FIG. 5 is a plan view of the cardboard blank used in the embodiment shown in FIG. 1.

FIG. 5 shows the cardboard blank from which the box 2 is made.

This blank comprises four rectangular faces 50, 51, 52 and 53 defined by the folding lines AB, CD, EF, GH and the cutting line IJ, which are all mutually parallel, and the folding lines BJ and AI which are also mutually parallel.

A gluing tab 54, bordered by the folding line AB and the cutting line KL (these lines being mutually parallel), makes it possible to join the face 50 to the face 53.

The folding lines AB, CD, EF and GH are extended beyond the points B, D, F and H by cutting lines which define gluing tabs 55, 56, 57 and 58 adjoining, respectively, the faces 50, 51, 52 and 53. These gluing tabs 55, 56, 57 and 58, assembled and glued in a conventional manner, form the base 4 of the box 2.

The cardboard blank also comprises tabs 59, 60, 61 and 62, adjoining, respectively, the faces 50, 51, 52 and 53, on the side opposite the gluing tabs 55, 56, 57 and 58. These tabs 59, 60, 61 and 62 have a width which is slightly smaller than the width of the faces 50, 51, 52 and 53.

Each tab 59, 60, 61 and 62 comprises a folding line, respectively MN, OP, QR and ST, parallel to the line AI and defining, respectively for each tab 59, 60, 61 and 62, a rectangular face 63, 64, 65 and 66 and areas 67, 68, 69 and 70 of diverse forms. The areas 67, 68, 69 and 70 are intended to form, on assembly of the box 2, the transverse wall 6.

The rectangular faces 63, 64, 65 and 66 are intended to be folded onto the faces 50, 51, 52 and 53 and to be glued thereon. The faces 63, 64, 65 and 66 and the part on which they are glued are intended to form, on assembly of the box 2, the enclosure 7, that is to say the extensions 9, 10, 11 of the lateral walls 5.

The areas 67, 68, 69 and 70 each comprise a cutout forming a circle or a part of a circle, capable of forming, on assembly of the box, the circular opening 8.

The area 68 comprises an oblique cutter line O'U delimiting a gluing zone 71 on its first surface. The area 67 comprises, on its first surface, a gluing zone 72 corresponding to the zone 71 and intended to be glued thereto.

In the same manner, the area 70 comprises an oblique cutter line S'V delimiting, on its first surface, a gluing zone 73. The area 69 comprises, on its first surface, a gluing zone 74 corresponding to the zone 73 and intended to be glued thereto.

The rectangular face 63 comprises two oblique cutter lines 21 joining the folding lines MN and AC as well as a cutter line 22 disposed along the folding line MN.

In a symmetrical manner (relative to the folding line AC), the upper part of the rectangular face 50 comprises two oblique cutter lines 21 and a transverse cutter line 22 joining the two cutter lines 21.

The cutter lines 21 and 22 of the faces 50 and 63 delimit, after folding of the tab 59 on the face 50, a double, detachable cardboard piece 23 of trapezoidal form, intended to form, after tearing, a notch facilitating pouring out.

The rectangular face 65 comprises a cutout 75 of elongated form. The face 52 comprises, in a symmetrical manner relative to the folding line EG, a window 17 of identical form. The window 17 comprises a straight folding line forming a hinge 18, a cutting line 19 and a cardboard piece 20 which can be folded over.

The first stage of assembly of the box consists in folding the gluing zones 71 and 73 along their respective cutter line O'U, S'V. The faces 63, 64, 65 and 66 are then folded over the rectangular faces 50, 51, 52 and 53 by means of rotation about the folding line AI.

The faces 63, 64, 65 and 66 are glued on the corresponding zones of the faces 50, 51, 52 and 53. The tab 62 is cut out so that it does not cover (when folded over the face 53) the gluing zone of the face 53 with the gluing tab 54.

As the tabs 59, 60, 61 and 62 are narrower than the rectangular faces 50, 51, 52 and 53, the folding lines AB, CD, EF and GH are not covered and remain free over their entire length.

The tabs 59, 60, 61 and 62 are then folded, performing a rotation of 90° about their respective folding line MN, OP, QR and ST.

The first surface of the gluing tab 54 is glued on the reverse surface of the face 53, along its edge IJ.

The gluing zone 71 is glued to the zone 72 and the zone 73 to the zone 74, the box 2 then being completely assembled.

The gluing tabs 55, 56, 57 and 58 will be assembled and glued in a conventional manner, after insertion of the bottle 3 into the box 2.

Figure 6:
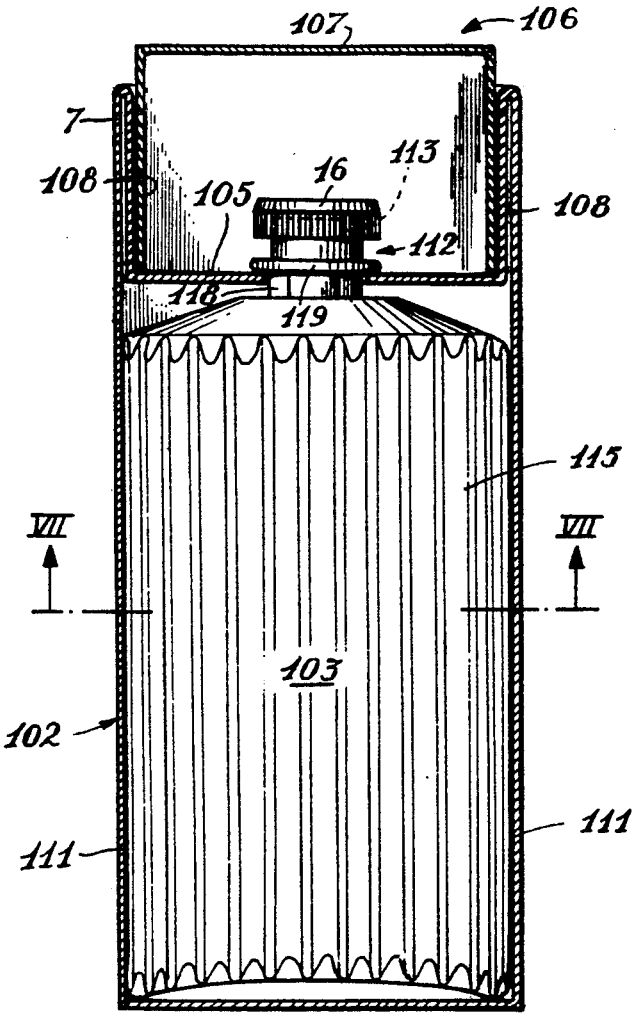
FIG. 6 is a view, similar to that in FIG. 1, of a further embodiment of packaging according to the invention.
Figure 7:
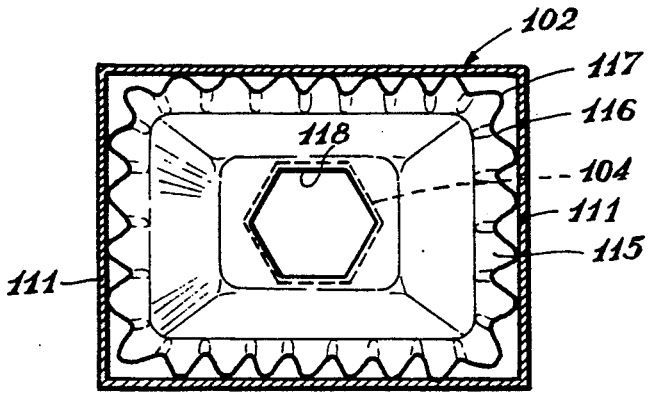
FIG. 7 is a section along the line VII—VII in FIG. 6.

FIGS. 6 and 7 show another embodiment of a packaging 101 according to the invention.

A box 102 of rectangular section contains a bottle 103. An opening 104 of hexagonal form is provided in the transverse wall 105.

The packaging 101 also comprises a cup 106. The cup 106 comprises a base 107, and lateral walls 108. When the cup 106 is placed on the box 102, the lateral walls 108 of the cup 106 rest on the perimeter of the transverse wall 105. The element for protecting the neck 7 encloses the lower part of the lateral walls 108 of the cup 106 and thus ensures satisfactory stability for this cup.

The lateral walls 108 of the cup 106 have a height which is equal to or greater than the part of the bottle 103 (neck 112, spout 113 and stopper 16) which is located outside the box 102. The free end of the lateral walls of the cup 106 is clasped by the enclosure, which ensures satisfactory stability for the cup 106.

During storage and palletization of the packaging 101, the bottle 103 (and more particularly its neck 112 and its spout 113) is protected both by the cup 106 and by the protecting element 7.

The cup may serve both for protection and, for example, as a measuring container for the product contained in the bottle 103. The walls of this cup may be lightened as much as possible or, on the other hand, be designed in order to take up a considerable part of the vertical stresses applied during stacking of the packagings.

The body 115 of the bottle 103 has a substantially rectangular section with rounded corners and is equipped, over its entire height and over its entire periphery, with grooves 116 and with ribs 117. It substantially matches the form of the lateral walls 111 of the box 102. The neck 112 of the bottle 103 has a lower part 118 of hexagonal form which interacts with the edges of the opening 104 so that the bottle 103 is wedged in rotation in the box 102. The wedging in rotation is aimed, above all, at preventing torsion of the body 115 of the bottle 103, on screwing of the stopper 16, in the case of bottles having a non-circular section.

The bottle 103 is also wedged in terms of height by virtue of the collar 119 which bears on the transverse wall 105.

Several variants may be given to the packaging described above without thereby departing from the scope of the invention.

In this way, substantially cylindrical bottles may be adapted equally to cylindrical boxes and to boxes of square, hexagonal or octagonal section, for example.

It is possible to manufacture bottles whose body is equipped with horizontal grooves or with a combination of horizontal and vertical grooves, or, alternatively, bottles which are stiffened by virtue of embossed diamond-shaped motifs, or even smooth bottles.

These various stiffening means prevent, as the bottle is emptied, the walls experiencing a detrimental sagging and forming retention pockets where the passage of the product is impeded.

The forms of the neck of the bottle and of the opening provided in the transverse wall of the box may be chosen according to requirements and regardless of the form chosen for the box and the bottle of the packaging.

In an advantageous embodiment not shown in the figures, the opening of the transverse wall of the box may have a polygonal form, for example hexagonal. The lower part of the neck of the bottle has a corresponding form. There is no collar, but rising above the lower part is a smooth zone corresponding to the thickness of the transversal wall, this smooth zone itself having rising above it an upper part of the neck having the same polygonal form and the same dimensions as the lower part, but offset angularly relative to the latter such that, when the lower part is engaged in the opening of the transverse wall, the bottom of the upper part bears on the transverse wall, thus ensuring locking in respect of height. This embodiment has the advantage of retaining the edges of the opening perfectly intact.

What is claimed is:

1. A packaging for liquid or pulverulent products, which comprises an assembly comprising a cardboard box and a bottle made from plastic material contained in this box without being attached thereto, the said box comprising lateral walls and a transverse wall in which an opening is provided, the said bottle comprising a base, a body, a neck capable of being engaged in the opening of the transverse wall and a spout on which a stopper is fitted, the bottle occupying a position in which its neck is engaged in the opening of the transverse wall of the box and its spout is located outside the box, this positioning being such that the bottle may thus be filled via the spout, the stopper positioned and removed when desired, and the contents of the bottle poured out via the spout, the said assembly comprising, moreover, an element for protecting the spout, carried by the box and arranged so that it surrounds the spout and so that its upper edge extends beyond that of the positioned stopper, the said element for protecting the spout comprising an enclosure formed by extensions of the lateral walls and folded-over faces adjoining these extensions, one of the extensions comprising cutter lines arranged so as to form, after detachment of a cardboard piece located between the cutter lines, a notch facilitating pouring-out of the contents of the bottle.

2. The packaging as claimed in claim 1, wherein the said element for protecting the spout comprises a cup capable of resting on the perimeter of the transverse wall of the box.

3. The packaging as claimed in claim 2, wherein the base of the cup is flush with the upper end of the enclosure.

4. The packaging as claimed in claim 3, wherein the cup is a measuring container.

5. The packaging as claimed in claim 1, wherein one of the said extensions comprises a window capable of forming a handle, the said window comprising a hinge.

6. The packaging as claimed in claim 5, wherein the said extension comprising a window is located opposite the said extension comprising cutter lines.

7. The packaging as claimed in claim 1, wherein the neck is equipped, over at least a part of its height, with means which can interact with the transverse wall in order to ensure holding of the spout outside the box when this neck is engaged in the opening of the transverse wall.

8. The packaging as claimed in claim 7, wherein the means which can interact with the transverse wall consist of a collar which surmounts the lower part of the neck.

9. The packaging as claimed in claim 1, wherein the box comprises, moreover, a base on which the base of the bottle can bear.

10. The packaging as claimed in claim 1, wherein the body of the bottle is sufficiently flexible for it to substantially match the lateral walls of the box.

11. The packaging as claimed in claim 10, wherein the body of the bottle is equipped over at least a part of its height with ribs and grooves capable of preventing the sagging of the walls when the bottle is partially empty.

12. The packaging as claimed in claim 11, wherein the box has a cylindrical form.

13. The packaging as claimed in claim 11, wherein the box has a prismatic form.

14. The packaging as claimed in claim 10, wherein the transverse section of the body of the bottle has a substantially circular form.

15. The packaging as claimed in claim 1, wherein the spout of the bottle as well as the stopper are threaded in a corresponding manner.

16. The packaging as claimed in claim 1, wherein the neck is equipped, at its lower part, with means which interact with the transverse wall in order to ensure its locking in in terms of rotation when it is engaged in the opening of the transverse wall.

17. The packaging as claimed in claim 1, wherein the body of the bottle is equipped, over at least a part of its height, with stiffening means capable of preventing the sagging of the walls when the bottle is not full.

18. The packaging as claimed in claim 17, wherein these stiffening means comprise grooves and ribs disposed in the axial direction.

19. The packaging as claimed in claim 7, wherein the stiffening means comprises grooves and ribs disposed in the radial direction.

20. The packaging as claimed in claim 1, wherein the transverse section of the body of the bottle has a substantially rectangular form with rounded corners.

* * * * *